US005320231A

United States Patent [19]

Iodice

[11] Patent Number: 5,320,231

[45] Date of Patent: Jun. 14, 1994

[54] ADULT PERSONAL CARE BOTTLE WITH INTEGRAL HANDLES

[75] Inventor: Jerry G. Iodice, Mahopac, N.Y.

[73] Assignee: Ansa Company, Inc., Norwalk, Conn.

[21] Appl. No.: 999,574

[22] Filed: Dec. 30, 1992

Related U.S. Application Data

[63] Continuation of Ser. No. 756,825, Sep. 9, 1991, abandoned.

[51] Int. Cl.[5] ..... A47G 19/22; B65D 23/10

[52] U.S. Cl. ..... 215/100 A; 215/229; 215/1 A; 220/709; 220/711; 220/771

[58] Field of Search ..... 215/1 A, 6, 10, 100 A, 215/229; 220/709, 711, 771; D9/378, 382, 447, 583, 449; D7/510, 511, 513, 533

[56] References Cited

U.S. PATENT DOCUMENTS

| | | | |
|---|---|---|---|
| D. 195,599 | 7/1963 | Platte et al. | D9/382 |
| D. 297,961 | 10/1988 | Egger | D9/382 X |
| D. 299,153 | 12/1988 | Hall | D9/528 X |
| D. 313,179 | 12/1990 | Guislain | D9/528 |
| 2,844,267 | 7/1958 | Petriccione | 215/229 X |
| 3,410,459 | 11/1968 | Conley | 215/100 A X |
| 3,443,710 | 5/1969 | Hills | 220/94 A X |
| 4,279,349 | 7/1981 | Aigner | 215/6 |
| 4,702,473 | 10/1987 | Paquette | D9/378 X |
| 4,703,927 | 11/1987 | Hanzlik | 215/6 X |
| 4,750,630 | 6/1989 | Campbell et al. | 220/94 A X |
| 4,765,514 | 8/1988 | Berglund | 220/94 A X |
| 4,813,556 | 3/1989 | Lawrence | 220/94 A X |
| 4,925,040 | 5/1990 | Wang | 215/1 A |

*Primary Examiner*—Sue A. Weaver

*Attorney, Agent, or Firm*—Wood, Herron & Evans

[57] ABSTRACT

A multi-purpose plastic bottle for adult personal care use in containing and dispensing liquid is disclosed having a generally cylindrical shape and tubular segments that define an aperture through the bottle so that it may be easily grasped by an adult. The bottle has a screw-type cap whereby its opening may be selectively closed or opened for dispensing liquid from the bottle.

9 Claims, 1 Drawing Sheet

ADULT PERSONAL CARE BOTTLE WITH INTEGRAL HANDLES

This application is a continuation of application Ser. No. 756,825, filed Sep. 9, 1991, now abandoned.

RELATED APPLICATION

This application is related to application Ser. No. 07/771,541 filed Oct. 10, 1991, now U.S. Pat. No. Des. 337,921, issued Aug. 3, 1993, which is incorporated herein by reference.

FIELD OF THE INVENTION

This invention relates to improvements in adult care bottles and, more particularly, a multipurpose plastic bottle for adult personal care in containing and dispensing liquids.

BACKGROUND OF THE INVENTION

Plastic bottles have been very well developed in the industrial arts. For instance, molded plastic bottles have substantially replaced glass in many areas of use as containers for liquid for general purposes. Integrally molded handles have been provided in such containers in order to facilitate the handling thereof for carrying, storage and dispensing purposes. In addition, in the case of babies or infants, a bottle has been provided with a central integral aperture to facilitate handling by an infant or the baby. U.S. Pat. No. 4,750,630 discloses an example of a baby bottle that is particularly designed and constructed to enable handling by the small hands of a baby in the dispensing of liquid during feeding operations.

There are currently available many different types of general utility plastic bottles for adult care use. These bottles while satisfactory for containing and dispensing liquids do not provide features that are desirable for adult care. For instance, there are plastic bottles that are currently being employed that serve as containers for soft drinks, milk and other nutritional liquids that are simply cylindrical in shape. These containers are bulky and difficult to handle. In a nursing home environment, for example, elderly people have difficulty in using containers that are bulky and do not facilitate being easily grasped and used. Handicapped personnel also have difficulty in using currently available containers. In the sports area, generally cylindrical bulky containers are also available and these present the same disadvantages for those containers that are available in health care related and other environments.

There has been a continuing need for improvements in containers that are particularly adapted for adult personal care use in containing and dispensing liquids.

SUMMARY OF THE INVENTION

This invention is directed to a multipurpose plastic bottle for adult personal care use in containing and dispensing liquids. The bottle is easily grasped by an adult user and is capable of being readily stored or carried by the person even during athletic endeavors. Thus, the bottle overcomes many disadvantages currently associated with available bottles for general utility purposes.

The integrally molded plastic bottle has generally cylindrical upper and lower sections connected by two tubular elements that define an opening in the bottle to enable it to be easily grasped by an adult user by gripping at least one of the tubular segments. The upper section of the bottle has an opening for receiving liquid and a closure that includes means for dispensing fluid from the bottle interior.

A removable screw-type cap cooperates with corresponding screw formations integrally molded in the top section of the bottle to seal the bottle and protect against accidental discharge of the contents. The removable cap also may be provided with a flip-up portion for dispensing liquid from the bottle. An aperture may also be provided for receiving a drinking straw for withdrawal of liquid from the bottle.

These and other features of the bottle of this invention will be further understood along with other advantages with reference to the drawings and following detailed description.

DETAILED DESCRIPTION OF THE PREFERRED EMBODIMENT

Figure 1:
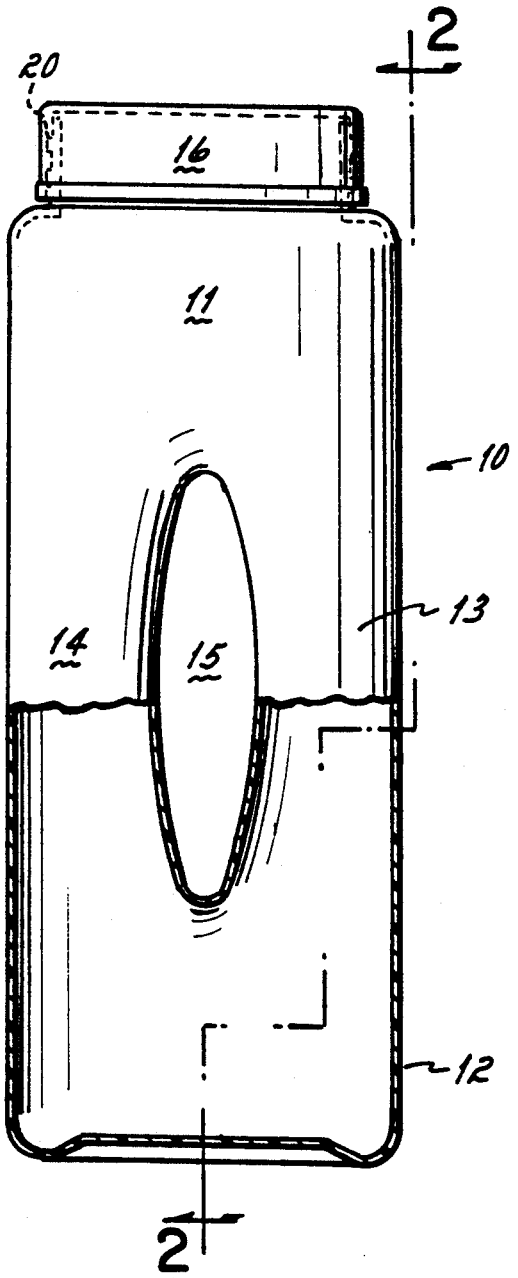
FIG. 1 is a front elevational view of an adult personal care bottle embodying the invention with a portion thereof shown in section for purposes of illustration.
Figure 2:
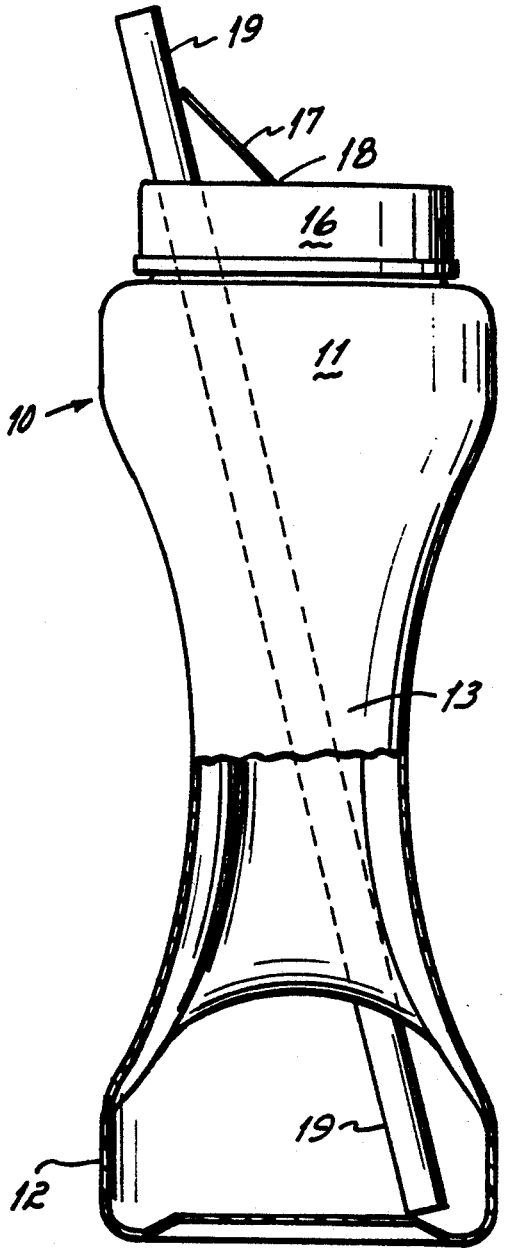
FIG. 2 is a side view of the bottle of FIG. 1 with a portion shown in section along the line 2—2 of FIG. 1.
Figure 3:
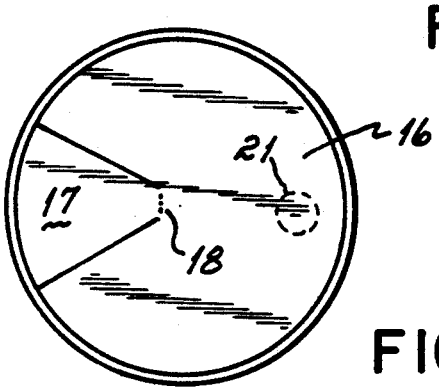
FIG. 3 is a top view of the cap of FIG. 1 showing a segment of the cap that comprises a flip-up portion for dispensing liquid directly or for the insertion of a straw for sipping liquid directly from the container as shown in FIG. 2.

Referring to the drawings in detail, particularly FIGS. 1-3, a multi-purpose plastic bottle is shown for adult personal care use in containing and dispensing liquid. An integrally molded plastic bottle 10 comprises a generally cylindrical upper section 11 and a lower section 12. These integrally molded sections are connected by two tubular segments 13 and 14. The tubular segments and upper and lower sections define an opening 15 through the bottle 10 as shown in FIG. 1. The opening 15 in the preferred construction is centrally located so that the bottle may be easily grasped by an adult user and provides a balanced container when liquid is fully or partially contained in the bottle. The upper section 11 has an opening for receiving liquid and a closure or cap 16 which is removably mounted by integrally molded screws 20 that cooperate with screw formation integrally molded (not shown) in the top of the bottle. As shown in FIG. 3, the bottle may have a cap with a flip-up portion 17 hinged at 18 for opening and dispensing liquid therefrom. Moreover, the aperture 21 through the cap may serve to receive a drinking straw 19 as shown in FIG. 2.

In its preferred forms, the bottle is designed for about 32 or 16 ounces of liquid while other forms of the bottle may contain more or less liquid as desired. In addition, the top opening of the bottle is constructed with dimensions to permit ice cubes of normal size to be inserted into the bottle and the central aperture 15 formed by the tubular members is well enough below the opening in the bottle to permit the insertion of the ice cubes.

Many advantages are provided by this bottle for adult personal care use in dispensing and containing liquid. For instance, the bottle of this invention is particularly useful in accommodating elderly adults and handicapped persons who need assistance in drinking from containers. A construction of the bottle enables it to be easily grasped by such individuals during use as well as when it is carried or stored. For active adults, such as those engaged in athletic endeavors during running, the bottle may be carried by hand during the athletic endeavor and liquid may be dispensed therefrom quite easily either by means of the flip-up portion 17 or other such means.

The bottle may be easily cleaned by the usual bottle brush or the like (not shown) when inserted into and through the tubular sections 13 and 14. It also may be cleaned in any well known manner by placement in automatic dishwashers. As indicated, the upper cylindrical section 11 is of sufficient size above the central opening in the bottle to permit ice to be inserted easily in order to maintain cool temperatures of the liquid in the bottle. Furthermore, the aperture 15 in the central portion of the bottle permits it to be carried by an adult on a belt or other means of clothing apparel so that it may be removed therefrom for use. It will also be understood that an active person, such as an athlete, when running may grasp the bottle easily by the insertion of fingers or a thumb through the central opening for comfortably holding the bottle.

In view of the above description it will be apparent that the invention provides a multi-purpose plastic bottle for adult personal care use in containing and dispensing liquids. It will also be apparent that further modifications may be made in view of the above description and drawings without departing from the spirit and scope of the invention.

What is claimed is:

1. A multi-purpose plastic bottle for adult personal care use in containing and dispensing liquids comprising an integrally molded plastic bottle having generally cylindrical upper and lower sections connected by two tubular segments, said tubular segments and said sections defining a central aperture through the bottle sized to receive the hand of an adult whereby the bottle is easily grasped by an adult user thereof, said upper section having an opening for receiving liquid and a closure including means for dispensing liquid from the bottle.

2. The bottle of claim 1 wherein said means for dispensing liquid comprises a flip-up portion of said closure.

3. The bottle of claim 1 wherein said closure has an aperture therethrough sized for receiving a drinking straw.

4. The bottle of claim 1 wherein said closure is a removable screw-type cap and said opening has a screw formation integrally molded therein for cooperation with said cap to provide said closure.

5. The bottle of claim 4 wherein said cap has a flip-up portion for dispensing liquid from the bottle.

6. The bottle of claim 4 wherein said cap has an aperture therethrough sized for receiving a drinking straw.

7. A multi-purpose plastic bottle for adult personal care use in containing and dispensing liquid comprising an integrally molded plastic bottle having generally cylindrical upper and lower sections connected by two tubular segments, said tubular segments and said sections defining a central aperture through the bottle sized to receive the hand of an adult whereby the bottle is easily grasped by an adult user thereof, said upper section having an integrally molded portion for cooperation with a removable cap having means for dispensing liquid therethrough.

8. The bottle of claim 7 wherein said means for dispensing liquid comprises a flip-up portion of said cap.

9. The bottle of claim 7 wherein said cap has an aperture therethrough sized for receiving a drinking straw.

* * * * *